United States Patent [19]

Steinhart

[11] Patent Number: 4,720,229

[45] Date of Patent: Jan. 19, 1988

[54] STACK PUSHER

[75] Inventor: Horst Steinhart, Westminster, Calif.

[73] Assignee: Rima Enterprises, Incorporated, Huntington Beach, Calif.

[21] Appl. No.: 927,059

[22] Filed: Nov. 5, 1986

[51] Int. Cl.[4] ..... B65H 31/30

[52] U.S. Cl. ..... 414/46; 198/468.11; 198/718; 414/31; 414/900

[58] Field of Search ..... 414/31, 46, 900; 198/468.11, 718, 747

[56] References Cited

U.S. PATENT DOCUMENTS

| | | | |
|---|---|---|---|
| 2,699,862 | 1/1955 | Walter | 198/747 |
| 3,114,308 | 12/1963 | Saxton et al. | 198/468.11 X |
| 3,595,370 | 7/1971 | Fujishiro | 414/46 X |
| 3,853,213 | 12/1974 | Lehman et al. | 198/429 X |
| 3,881,298 | 5/1975 | Griner | 414/46 X |
| 4,547,112 | 10/1985 | Steinhart | 414/31 |

FOREIGN PATENT DOCUMENTS

| | | | |
|---|---|---|---|
| 55-11494 | 1/1980 | Japan | 414/46 |
| 567996 | 10/1975 | Switzerland | 414/46 |

*Primary Examiner*—Leslie J. Paperner

*Attorney, Agent, or Firm*—Tarolli, Sundheim & Covell

[57] ABSTRACT

A pusher assembly for use with a signature stacker pushes a stack of signatures from the stacker. The pusher assembly includes a pusher bar, a linkage for moving the pusher bar, and a controller for adjusting the length of travel of the pusher bar. The pusher bar is supported for reciprocating movement along a length of travel for engaging the stack of signatures. The linkage is connected to an extendible fluid cylinder which moves the linkage upon actuation to push the stack of signatures from the stacker. The controller actuates the fluid cylinder and is adjustable as a function of signature width for pushing various width stacks from the stacker.

15 Claims, 4 Drawing Figures

STACK PUSHER

BACKGROUND OF THE INVENTION

The present invention relates to a signature stacker and, particularly to an apparatus for pushing a stack of signatures from the stacker.

A known stacker which stacks folded signatures is disclosed in U.S. Pat. No. 4,547,112. The stacker includes a temporary signature holding assembly, a revolvable turntable and a pusher assembly. The temporary signature holding assembly collects a temporary stack of signatures from a continuous infeed supply while the pusher moves a completed stack from the turntable or while the turntable is revolving to alternate the fold location. This permits the infeed supply to continue without disruption.

The temporary signature holding assembly is disposed directly above the turntable. The temporary signature holding assembly pivots downwardly from a collecting position to allow the temporary stack to fall onto the center of the turntable. The temporary signature holding assembly then returns to the collecting position. When a stack has the desired number of signatures, the pusher is actuated to push the stack onto a delivery table.

The stacker can stack signatures of various widths. The pusher assembly of the known stacker has a single travel length regardless of the width of the signatures. The pusher is designed to have a long travel to push the longest width stack from the stacker and onto the delivery conveyor. Therefore, when relatively large width stacks are pushed, the pusher assembly must cycle through the long travel. This results in wasted pusher motion and cycle time because the temporary signature holding assembly cannot drop signatures onto the platform until the pusher completely returns to a starting position which will not interfere with the falling of signatures onto the turntable.

SUMMARY OF THE INVENTION

The present invention provides a new and improved apparatus for pushing a stack of signatures from a stacker. Specifically, a stack pusher is provided which has an adjustable travel length. The travel length is adjusted in relation to the width of the stack to be pushed from the stacker. Thus, the present invention minimizes wasted pusher motion and cycle time in order to increase stacker throughput. The apparatus includes a pusher bar, a linkage connected with means to move the pusher bar through a length of travel, and means for adjusting the length of travel of the pusher bar.

In the preferred embodiment, the pusher bar is supported for reciprocating movement by support rails. The pusher bar is connected with the linkage. The linkage is pivotally mounted and connected with the means to move the pusher bar through a length of travel. The means to move the pusher bar includes a pneumatic cylinder.

The means for adjusting the length of travel of the pusher bar includes a cam, a proximity switch, and a controller. The cam is connected to the linkage and pivots therewith. The cam includes a plurality of projections extending from a cam plate. The projections move through an arc as a result of the linkage pivoting. The proximity switch is mounted near the cam. When a projection moves past the proximity switch, an electric pulse is sent to the controller.

The controller has a first memory register set to a first number corresponding to an initial position of the pusher bar. The controller also has a second memory register set to a second number corresponding to the desired end position of travel of the pusher bar. The end position is adjustable as a function of signature width.

When the stacker has a desired number of signatures on the platform, the controller actuates the pneumatic cylinder to move the pusher bar from the initial position. The controller counts the number of electric pulses that the proximity switch sends as a result of projections passing during pusher bar movement in a push direction. When the counter reaches the second number corresponding to the desired end position, the controller directs the pneumatic cylinder to stop the pusher bar from moving in a push direction. The controller then directs the pneumatic cylinder to move the pusher bar in a return direction to the initial position. Thus, the travel length and time that it takes for the pusher to push a relatively wide stack from the stacker and return to the initial position is minimized.

BRIEF DESCRIPTION OF THE DRAWINGS

The foregoing and other advantages and features of the present invention will become apparent to one skilled in the art to which the present invention relates upon a reading of the following description made with reference to the accompanying drawings, wherein.

DESCRIPTION OF A SPECIFIC PREFERRED EMBODIMENT

Figure 1:
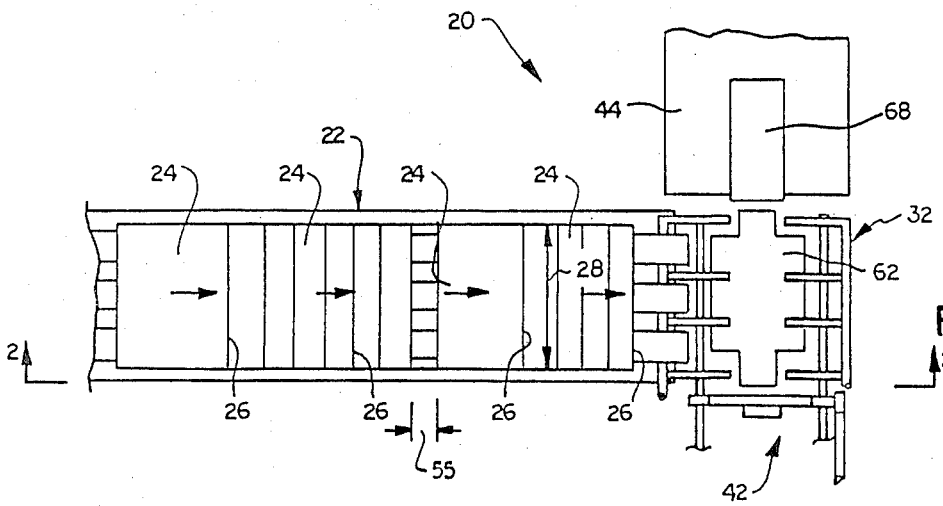
FIG. 1 is a schematic top view of a signature handling apparatus and a stacker incorporating the present invention.
Figure 2:
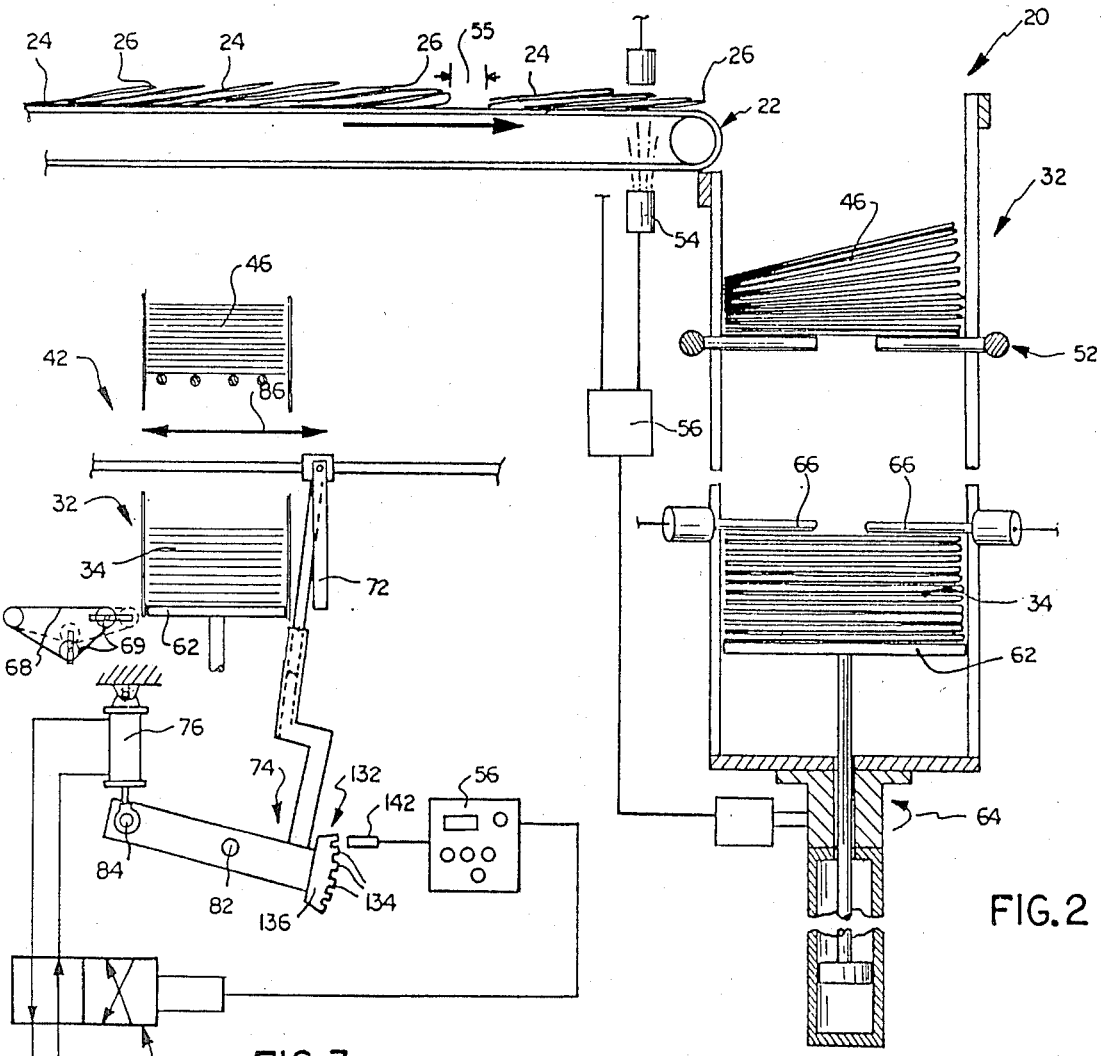
FIG. 2 is a schematic cross sectional view, taken approximately along the line 2—2 of FIG. 1.

A signature handling apparatus 20 is illustrated in FIGS. 1 and 2. The signature handling apparatus 20 includes an infeed conveyor 22 along which signatures 24 are fed in a lapped, or shingled, relationship with the folded edge portion 26 of each signature leading. The signatures 24 have a width 28 which may vary among different stacking runs. The signatures 24 are fed from the infeed conveyor 22 to a signature stacker 32 (FIG. 2) to form a work staok 34. The stacker 32 produces a generally rectangular and relatively stable work stack 34 having a desired quantity of signatures 24. A pusher assembly 42 (FIGS. 1 and 3) sequentially pushes the work stack 34 onto a delivery table 44.

The signatures 24 are delivered onto a temporary signature holding assembly 52 (FIG. 2) to form a temporary stack 46. The temporary stack 46 is formed to allow the work stack 34 to be flattened, layered, or pushed off a turntable 62 without interferring in those operations while permitting continuous infeed of signatures 24.

A counter (not shown) is located upstream of the signature 24 infeed conveyor 22 to count a desired number of signatures which will form a temporary stack 46. A gapper (not shown) creates a gap in the shingled signatures 24 to separate the number of signatures that will form a temporary stack 46. A photoelectric device 54 senses the gap 55 as the signatures 24 pass onto the temporary signature holding assembly 52. The photoelectric device 54 signals a controller 56 each time a gap 55 is detected. The controller 56 compares the number of temporary stacks 46 already delivered to the work stack 34 with a predetermined number corresponding to the number of temporary stacks which will make up a completed work stack. When the predetermined number has not been reached, and when the flattening or layering operations is not be interfered with, the controller 56 signals the temporary signature holding assembly 52 to pivot downwardly. The temporary stack 46 falls to either the existing work stack 34 or to an empty turntable 62 below. The temporary signature holding assembly 52 then returns to a closed position to receive more signatures 24.

After the temporary stack 46 has fallen below, the turntable 62 receives a signal from the controller 56 to rotate 180°, as indicated by the arrow 64. This alternates the location of the folded portion 26 in layers in the work stack 34. This alternate layer effect tends to form a more stable rectangular work stack 34 of signatures. Additionally, after the temporary stack 46 has fallen onto the turntable 62 or work stack 34, the controller signals the turntable 62 to raise the stack against a plurality of extended compression rods 66. This tends to flatten the work stack 34 making an even and more stable stack of signatures. The turntable 62 then lowers a predetermined distance and the compression rods 66 are retracted to allow the next temporary stack 46 to fall. A detailed description of the operation of such a signature handling apparatus 20 is more fully described in U.S. Pat. No. 4,547,112 which is incorporated herein by reference.

The turntable 62 is interchangeable. The turntable 62 may be selected from various sized turntables which correspond to the width 28 of the signatures 24 which are being stacked. This minimizes the distance which a work stack 34 must travel in order to be pushed off of the turntable 62.

When the controller 56 has determined that a predetermined number of temporary stacks 46 comprises the work stack 34, the pusher assembly 42 (FIGS. 1 and 3) is signaled to push the work stack 34 from the turntable 62. The work stack 34 is pushed onto the delivery table 44. The delivery table 44 includes a belt assist conveyor 68 part of which is disposed along an upper surface of the delivery table and which is driven in the direction that the work stack 34 is being pushed. The belt assist conveyor 68 reduces the load that the pusher assembly 42 encounters at the end of its length of travel due to the weight of the work stack 34. The belt assist conveyor 68 can be driven at varying speeds which are selected to correspond to the size and weight of the work stack 34. The belt assist conveyor 68 includes two idler wheels 69 (FIG. 3) which are fixed to the delivery table 44 and are adjustable to vary the effective length of the belt at the table surface. This permits the belt to be disposed adjacent the turntable 68 regardless of the size of the turntable used.

The pusher assembly 42 includes a pusher bar 72 (FIG. 3), a linkage 74 and a pneumatic cylinder 76. The pusher bar 72 is pivotally connected with the linkage 74 at a bearing 80 (FIG. 4). The linkage 74 is supported for pivotal movement at a bearing 82. The pneumatic cylinder 76 is fixed at one end and pivotally connected to the linkage 74 at a bearing 84. The pneumatic cylinder 76 is a double acting piston type, and is controlled to extend or retract by control valve 152 (FIG. 3), as is known. When the pneumatic cylinder 76 extends, the linkage 74 pivots about the bearing 82 and the pusher bar 72 moves to the left, as viewed in FIG. 3, along a direction of travel 86. When the pneumatic cylinder 76 retracts, the linkage 74 pivots and the pusher bar 72 moves to the right along the direction of travel 86.

The pusher bar 72 is supported by a cross bar 92 (FIG. 4) between a pair of support rails 94. The cross bar includes two bearing portions 96, 98 which slide along the support rails 94. The pusher bar 72 also includes a bearing surface 102 which slidably engages an appropriate guide (not shown) on the turntable 62.

The linkage 74 includes a first link 112 and a second link 114. The first link 112 includes a first portion 122 and a second portion 124. The first portion 122 is connected with the cross bar 92 at the bearing 80. The second portion 124 is tubular and of slightly larger cross section than the first portion 122. The first portion 122 is inserted into the second portion 124. The first portion 122 is slidable in the second portion 124 in a direction indicated by arrows 126 when the linkage 74 pivots about the bearing 82.

The length of travel of the pusher bar 72 (FIG. 3), which is the distance the pusher bar travels from an initial position, is adjustable. Adjustment of the length of travel of the pusher bar 72 is accomplished by an apparatus which includes a cam 132, a sensor 142, the controller 56 and a control valve 152. The cam 132 is fixedly connected to the second link 114 of linkage 74. The cam 132 moves in an arc in proportion to pivotal movement of the linkage 74. The cam 132 has a plurality of projections 134 extending from a cam plate 136. The circumferential spacing of the projections 134 about the cam plate 136 is preferably equal.

The sensor is a proximity switch 142 mounted near the cam 132. The proximity switch 142 includes a portion 146 which emits a relatively weak magnetic field. When a projection 134 passes the proximity switch 142, the magnetic field is disrupted which is sensed by the proximity switch. The proximity switch 142 transmits an electric pulse to the controller 56 (FIG. 3) each time a projection 134 passes the proximity switch. While one type of displacement sensing device has been described to be in the form of a cam 132 and proximity switch 142, it will be apparent that other displacement sensing devices may be adapted to achieve similar results.

The electric pulse is directed to a counter in the controller 56. The counter counts the number of pulses. The controller 56 also has a first memory register and a second memory register. The first memory register stores a first number corresponding to the initial position of tne pusher bar 72. The second memory register stores a second number corresponding to a desired end position of the pusher bar 72 along its travel length. The second number is different from the first number by the number of pulses received by the controller 56 as the pusher bar 72 is moved from the initial position to the desired end position during a set-up procedure. The position of the pusher bar 72, relative to the initial and desired end positions, is therefore known to the controller 56 by the difference of the count number from the first and second numbers.

The count is periodically compared with the first and second numbers. When the second number is reached, the controller 56 signals the control valve 152 to restrict fluid flow to a work chamber of the pneumatic cylinder 76. The movement of the pusher bar 72 is thus stopped.

The control valve 152 is then signalled by the controller 56 to allow fluid flow into another work chamber of the pneumatic cylinder 76 to move the linkage 74 and pusher bar 72 in a return direction.

Figure 3:
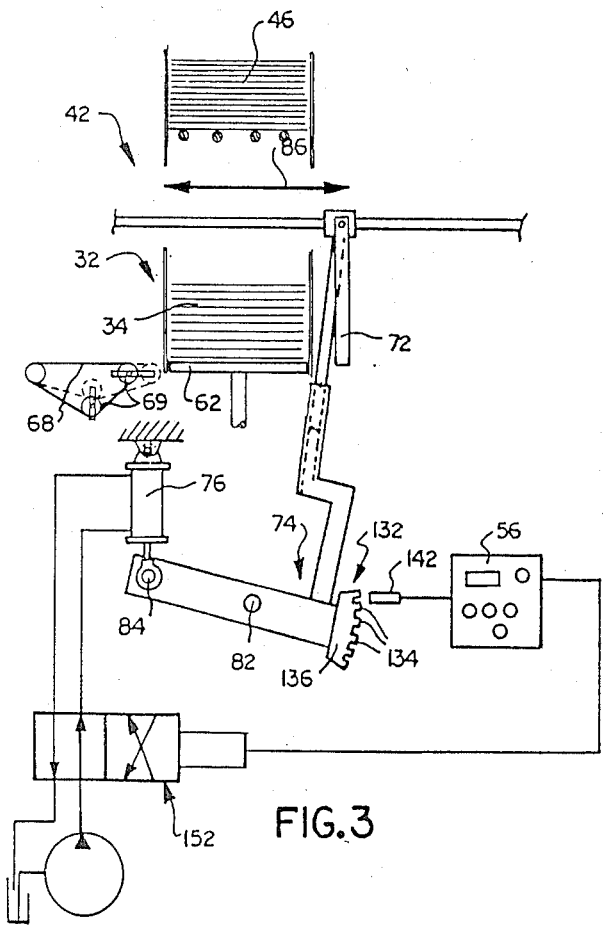
FIG. 3 is a schematic side view of the stack pusher of the present invention.
Figure 4:
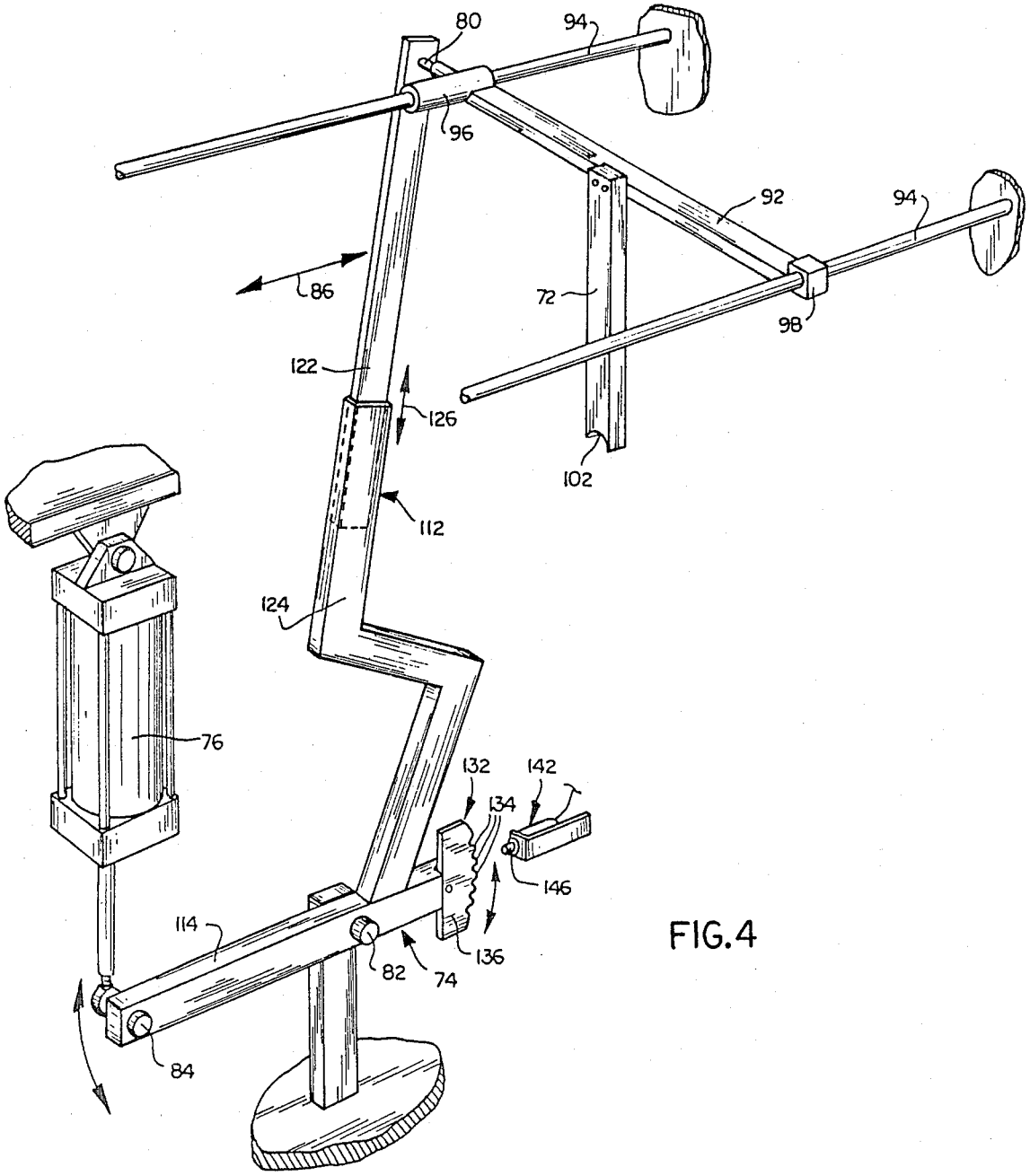
FIG. 4 is a perspective view of the linkage, pusher bar, and support rails of the stack pusher.

To operate the pusher assembly 42, the controller 56 is powered on and the pusher bar 72 moves to an initial position which will not interfere with forming a stack 34 on the turntable 62, as illustrated in FIG. 3. When the pusher bar 72 is at the initial position, the first number is initialized (i.e., the first controller memory register is set to zero). The first number corresponds to the initial position of the pusher bar 72. Initialization of the first number may be done by an operator pressing an appropriate switch on the controller 56 or done automatically by the controller.

The pusher bar 72 is then moved in the push direction, to the left along the direction of travel as indicated by the arrow 86 (FIG. 3), until the desired end position is reached. The desired end position is the position determined to be sufficient to push the given stack 34 of signatures from the turntable 62 and onto the delivery table 44. Movement may be accomplished by jogging the pusher bar 72 to the desired position by pressing an appropriate switch on the controller 56. As the pusher bar 72 moves to the end position, the cam 132 pivots past the proximity switch 142. The controller 56 counts the pulses as each projection 134 passes the sensor 142. The second number is the number of pulses counted plus the value of the first number. The operator then presses a switch to enter the second number into the second controller memory register. The second number corresponds to the desired end position of the push bar 72. The pusher bar 72 is then returned to its initial position.

The controller 56 now has two numbers registered in memory which correspond to the initial position and the desired end position of pusher bar 72 travel. The second number was established by merely counting the number of projections 134 passing the proximity switch 142. It will be apparent that a greater degree of resolution and control of pusher bar 72 movement can be obtained by having a greater number of projections 134 spaced along the cam 132. It will also be apparent that several numbers can be stored in the controller 56 memory which correspond to the desired end positions required to push work stacks 34 of various widths 28 from the turntable. The operator can then merely indicate to the controller 56 which width 28 of a work stack 34 is to be pushed from the turntable and the controller will enter the proper second number.

The end position of pusher bar 72 travel was adjusted to be the minimum travel required to push a work stack 34 of signatures from the turntable 62 onto the delivery table 44. The minimum length of travel was adjusted as a function of stack width 28 and turntable 62 size. Therefore, for work stacks 34 of a relatively small width 28, the length of travel required to push a work stack 34 onto the delivery table 44 will tend to be greater than for work stacks 24 of a relatively large width 28.

After the set-up operation, the signature handling apparatus 20 (FIGS. 1 and 2) is then operated to form work stacks 34 from the individual signatures 24. After the controller 56 (FIG. 2) determines that a desired number of temporary stacks 46 have been deposited on the turntable 62 and flattened, the controller signals the pneumatic control valve 152 to allow fluid flow to a work chamber in the cylinder 76. This moves the pusher bar 72 from the initial position in a push direction to push a work stack 34 from the turntable 62. As the pusher bar 72 moves in the push direction, to the left as illustrated by the arrow 86 in FIG. 3, the cam 132 pivots upwardly. As each projection 134 passes the proximity switch 142, a pulse is sent to the controller 56 and is counted and retained in the count register. The counter register is periodically compared to the second number.

When the count register equals or exceeds the second number, the controller 56 signals the control valve 152 to stop fluid flow to the pneumatic cylinder 76. This stops the pusher bar 72 from further movement in the push direction. The controller 56 then signals the control valve 152 to allow fluid flow to another work chamber in the pneumatic cylinder 76 which forces the pusher bar 72 in a return direction, to the right as illustrated by arrow 86 in FIG. 3. The pusher bar 72 then returns to the initial position. This cycle is repeated for each work stack 34 that is to be pushed from the turntable 62.

Thus, the pusher bar 72 is required to traverse the minimum distance required to push the work stack 34 of signatures from the turntable 62. This is done by providing an apparatus which is adjustable in the ending position as a function of signature width 28. Therefore, wasted motion and time of the pusher assembly 42, which prevents signatures 24 from being stacked, is minimized.

It will be obvious to those skilled in the art that the present invention may be adapted for use with various other stackers without detracting from the spirit of the present invention. From the above description of a preferred embodiment, those skilled in the art will perceive improvements, changes and modifications and such improvements, changes and modifications within the skill of the art are intended to be included herein and covered by the spirit and scope of the hereinafter appended claims.

Having described a preferred embodiment, I claim:

1. An apparatus for use with a signature stacker, said apparatus comprising:

a pusher bar supported for reciprocating movement along a length of travel and for engaging a stack of signatures in the stacker;

means for moving said pusher bar to push the stack of signatures from the stacker; and means for adjusting the length of travel of the pusher bar as a function of signature size;

said means for moving said pusher bar comprising:

a linkage supported for pivotal movement and connected with said pusher bar, and means for effecting pivotal movement of said linkage including an extendable fluid cylinder connected with said linkage;

said apparatus further including a cross bar and a pair of support rails, said support rails being connectable with the stacker, said cross bar being pivotally connected with said linkage, said cross bar having an intermediate portion connected with said pusher bar and end portions with bearing surfaces for sliding engagement with said support rails;

said linkage including a first link fixedly connected to a second link, said second link being supported for pivotal movement, said first link having first and second portions, said first portion being pivotally connected with said cross bar, said second portion being fixedly connected to said second link, said first and second portions being of different cross sectional sizes and one of said first and second portions being coaxially disposed inside of the other of said first and second portions for relative sliding upon pivotal movement of said linkage.

2. An apparatus for use with a signature stacker, said apparatus comprising:

a pusher bar supported for reciprocating movement along a length of travel and for engaging a stack of signatures in the stacker;

means for moving said pusher bar to push the stack of signatures from the stacker; and means for adjusting the length of travel of the pusher bar as a function of signature size;

said means for moving said pusher bar comprising:

a linkage supported for pivotal movement connected with said pusher bar, and means for effecting pivotal movement of said linkage including an extendible fluid cylinder connected with said linkage;

said means for adjusting the length of travel of the pusher bar comprising:

a cam connected with said linkage and pivotal therewith, said cam having a plurality of projections extending radially therefrom in a plane parallel to a plane in which said linkage pivots, sensor means for sensing one of said plurality of projections as said cam moves past said sensor means and for generating an electrical pulse in response to one of said plurality of projections being sensed, and control means for counting said pulses from a first number which corresponds to an initial position of said pusher bar, said control means including a control valve fluidly connected with a working chamber of said fluid cylinder and actuatable to stop fluid flow to said fluid cylinder in response to the count number reaching a second number.

3. An apparatus as set forth in claim 2 wherein said control means is adjustable to set the second number to correspond to a desired end position of said pusher bar.

4. An apparatus as set forth in claim 2 wherein said sensor means emits a magnetic field and each of said projections disrupts the magnetic field as said projection passes said sensor means, said sensor means adapted to electrically communicate each disruption of the magnetic field to said control means.

5. An apparatus for use with a signature stacker, said apparatus comprising:

a pusher bar supported for reciprocating movement along a length of travel and for engaging a stack of signatures in the stacker;

means for moving said pusher bar to push the stack of signatures from the stacker; and means for adjusting the length of travel of the pusher bar as a function of signature size, said means for adjusting the length of travel of the pusher bar including means for sensing the position of said pusher bar during movement and means for controlling the movement of said pusher bar in response to the position of said pusher bar along the length of travel differing from a desired position of said pusher bar.

6. A signature stacker comprising:

a turntable;

signature holding means disposed above said turntable for temporarily collecting signatures to form a pile and for dropping the pile onto said turntable to form a stack;

a pusher bar supported for reciprocating movement along a length of travel and for engaging the stack;

means for moving said pusher bar to push the stack from said turntable; and means for adjusting the length of travel of the pusher bar as a function of signature width;

said means for moving said pusher bar comprising:

a linkage supported for pivotal movement connected with said pusher bar, and means for effecting pivotal movement of said linkage including an extendable fluid cylinder connected with said linkage;

said stacker further including a cross bar and a pair of support rails, said support rails being connectable with said stacker, said cross bar being pivotally connected with said linkage, said cross bar having an intermediate portion connected with said pusher bar and end portions with bearing surfaces for sliding engagement with said support rails;

said linkage including a first link fixedly connected to a second link, said second link being supported for pivotal movement, said first link having first and second portions, said first portion being pivotally connected with said cross bar, said second portion being fixedly connected to said second link, said first and second portions being of different cross sectional sizes and one of said first and second portions being coaxially disposed inside of the other of said first and second portions for relative sliding upon pivotal movement of said linkage.

7. An apparatus as set forth in claim 6 wherein said means for adjusting the length of travel of the pusher bar comprises a cam connected with said linkage and pivotal therewith, said cam having a plurality of projections extending radially therefrom in a plane parallel to a plane in which said linkage pivots, sensor means for sensing one of said plurality of projections as said cam moves past said sensor means and for generating an electrical pulse in response to one of said plurality of projections being sensed, control means for counting said pulses from a first number which corresponds to an initial position of said pusher bar, said control means including a control valve fluidly connected with a working chamber of said fluid cylinder and actuatable to stop fluid flow to said fluid cylinder in response to the count number reaching a second number.

8. A stacker as set forth in claim 7 wherein said control means is adjustable to set the second number to correspond to a desired end position of said pusher bar.

9. A stacker as set forth in claim 7 wherein said sensor means emits a magnetic field and each of said projections disrupts the magnetic field as said projection passes said sensor means, said sensor means adapted to electrically communicate each disruption of the magnetic field to said control means.

10. A signature stacker comprising:

a turntable;

signature holding means disposed above said turntable for temporarily collecting signatures to form a pile and for dropping the pile onto said turntable to form a stack;

a pusher bar supported for reciprocating movement along a length of travel and for engaging the stack;

means for moving said pusher bar to push the stack from said turntable; and means for adjusting the length of travel of the pusher bar as a function of signature width, said means for adjusting the length of travel of the pusher bar including means for sensing the position of said pusher bar during movement and means for controlling the movement of said pusher bar in response to the position of said pusher bar along the length of travel differing from a desired position of said pusher bar.

11. A stacker as set forth in claim 10 wherein said turntable is selected from a plurality of turntables of various sizes.

12. A stacker as set forth in claim 10 further including a delivery table upon which a stack of signatures is pushed by said pusher bar, said delivery table being disposed adjacent said turntable.

13. A stacker as set forth in claim 12 further including a movable belt conveyor, part of said belt conveyor being disposed along a portion of an upper surface of said delivery table and disposed adjacent said turntable, said belt conveyor being driven so that said part of said belt conveyor disposed along the upper surface of said delivery table moves in the direction of stack movement to assist the pusher bar in moving the stack from said turntable.

14. An apparatus for use with a signature stacker, said apparatus comprising:

a pusher bar supported for reciprocating movement along a length of travel and for engaging a stack of signatures in the stacker;

means for moving said pusher bar to push the stack of signatures from the stacker; and means for selecting the length of travel of the pusher bar to provide for different lengths of travel for different size signatures, said selecting means including a controller for controlling said moving means in accordance with a selected signature size and means for actuating said moving means in response to a signal from said controller to cause said moving means to move said pusher bar a selected length of travel.

15. An apparatus as set forth in claim 14 wherein said means for moving said pusher bar comprises:

a linkage supported for pivotal movement connected with said pusher bar, and means for effecting pivotal movement of said linkage including an extendible fluid cylinder connected with said linkage; and said actuating means comprising a control valve fluidly connected with a working chamber of said extendible fluid cylinder for controlling fluid flow to said working chamber to change the stroke of said extendible fluid cylinder to thereby change the amount of pivotal movement of said linkage.

* * * * *